US011359818B2

(12) United States Patent
Martin et al.

(10) Patent No.: US 11,359,818 B2
(45) Date of Patent: Jun. 14, 2022

(54) GAS BURNER

(71) Applicant: Electrolux Home Products, Inc., Charlotte, NC (US)

(72) Inventors: Brian Martin, Nashville, TN (US); Michael Dennis Padgett, Springfield, TN (US); Warren Fowler, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 201 days.

(21) Appl. No.: 16/704,189

(22) Filed: Dec. 5, 2019

(65) Prior Publication Data

US 2020/0182474 A1 Jun. 11, 2020

Related U.S. Application Data

(60) Provisional application No. 62/776,771, filed on Dec. 7, 2018.

(51) Int. Cl.

| | |
|---|---|
| ***F24C 3/08*** | (2006.01) |
| ***F24C 3/12*** | (2006.01) |
| ***F23D 14/02*** | (2006.01) |

(52) U.S. Cl.

CPC ..... *F24C 3/082* (2013.01); *F24C 3/122* (2013.01); *F23D 14/02* (2013.01)

(58) Field of Classification Search

CPC ..... F24C 3/082; F24C 3/122; F24C 3/085; F24C 15/108; F24D 14/02; F24D 14/06; F23D 2900/4062; F23D 14/06; F23D 2207/00

See application file for complete search history.

(56) References Cited

U.S. PATENT DOCUMENTS

| | | | | |
|---|---|---|---|---|
| 5,924,860 | A * | 7/1999 | Massey | F23D 14/06 431/354 |
| 6,889,685 | B2 * | 5/2005 | Dane | F23D 14/06 126/39 B |
| 7,291,009 | B2 * | 11/2007 | Kamal | F24C 3/085 431/278 |
| 9,341,380 | B2 * | 5/2016 | Vaglica | F23Q 3/008 |
| 10,551,056 | B2 * | 2/2020 | Caloca | F23D 14/06 |
| 10,663,164 | B2 * | 5/2020 | Rasi | F23D 14/08 |
| 10,690,351 | B2 * | 6/2020 | Adams | F23D 14/06 |
| 2016/0327277 | A1 * | 11/2016 | Emiliani | F23D 14/26 |
| 2017/0038061 | A1 * | 2/2017 | Geng | F23M 9/02 |

(Continued)

*Primary Examiner* — Jorge A Pereiro
*Assistant Examiner* — Nikhil P Mashruwala
(74) *Attorney, Agent, or Firm* — Pearne & Gordon LLP

(57) ABSTRACT

A gas burner includes a base with a first body and a raised annular band on an upper surface of the first body. A flange is formed about an outer periphery of the first body wherein the raised annular band and the flange define a first annular recess therebetween. A first notch is formed in a lower surface of the first body and extends through the flange and communicates with the first annular recess. The first notch is adapted to accommodate spark ignitor therein. A slot is formed in the raised annular band. A first cap includes a peripheral side wall having a distal end dimensioned to be received within the first annular recess. A gap between the distal end and a bottom wall of the first annular recess when the first cap is received therein provides fluid communication between the slot and the first notch.

17 Claims, 18 Drawing Sheets

(56) References Cited

U.S. PATENT DOCUMENTS

| | | | | |
|---|---|---|---|---|
| 2019/0107287 | A1* | 4/2019 | Kitabayashi | F23N 3/007 |
| 2020/0191387 | A1* | 6/2020 | Noeth | F23L 1/00 |
| 2020/0256557 | A1* | 8/2020 | Rasi | F23D 14/06 |

* cited by examiner

GAS BURNER

FIELD OF THE INVENTION

The present invention relates to gas burners for a cooktop appliance, and more particularly, to a top breathing gas burner having a plurality of a burner ports formed in a cap of the gas burner.

BACKGROUND OF THE INVENTION

Gas cooktop appliances often have one or more gas burners. The gas burners are designed to mix gas with air to generate a flame. Most gas burners are top-breathing, which means that they draw air form above a surface of the appliance. However, these gas burners are susceptible to being extinguished, a condition often referred to as "flame out." Flame out often occurs when the gas burner is exposed to pressure waves. The pressure waves have the tendency to move the flame from the orifices of the burner. Subsequently, during flame out, the flame generated by the gas burner is extinguished but the gas continues to emanate from the gas burner. This creates a dangerous condition for the user.

It is desirable to have a gas burner that is less susceptible to flame out conditions. The present invention provides a top breathing gas burner that reduces the risk of flame out when exposed to pressure waves.

SUMMARY OF THE INVENTION

There is provided a gas burner that includes a base with a first body and an opening extending axially through the first body. A raised annular band is formed on an upper surface of the first body and surrounds an outlet of the opening. A flange is formed about an outer periphery of the first body wherein the raised annular band and the flange define a first annular recess therebetween. A first notch is formed in a lower surface of the first body and extends through the flange and communicates with the first annular recess. The first notch is adapted to accommodate spark ignitor therein. A slot is formed in the raised annular band. A first cap includes a peripheral side wall having a distal end dimensioned to be received and accommodated within the first annular recess. A gap between the distal end and a bottom wall of the first annular recess when the first cap is received therein provides fluid communication between the slot and the first notch. A gas burner port is formed in the peripheral side wall of the first cap.

There is also provided an appliance that includes a cooktop panel and a gas burner mounted on the cooktop panel. The gas burner includes a base. The base includes a first body and a second body radially spaced from and concentrically surrounding the first body. The first and second bodies having respective first and second lower surfaces spaced above the cooktop panel to define a circumferential air inlet of the gas burner. An opening extends axially through the base and has an inlet fluidly connected to the circumferential air inlet and an outlet in an upper surface of the first body. A raised annular band is formed on an upper surface of the first body. The raised annular band surrounds the outlet of the opening. A flange is formed about an outer periphery of the first body wherein the raised annular band and the flange define a first annular recess therebetween. A first notch formed in a lower surface of the first body extends through the flange and communicates with the first annular recess. A slot is formed in the raised annular band. A first cap includes a peripheral side wall having a distal end received and accommodated within the first annular recess. A gap between the distal end and a bottom wall of the first annular recess provides fluid communication between the slot and the first notch. A plurality of gas burner ports are formed and circumferentially spaced in the peripheral side wall of the first cap. A second cap is supported on the second body and therewith defines an outer annular cavity. The second cap includes a row of gas burner ports extending radially on an upper surface thereof and fluidly communicating with the outer annular cavity and a plurality of gas burner ports disposed and spaced circumferentially in an outer wall of the second cap.

There is further provided a method of operating a gas burner comprising steps of: flowing a combustible gas through a mixing chamber formed in a body of the gas burner wherein the combustible gas draws surrounding air into the mixing chamber through a circumferential opening defined between a bottom of the body and a top of a cooktop panel to which the gas burner is mounted; combining the combustible gas and air in the mixing chamber to form a mixture; flowing the mixture to an upper volume of the gas burner; a first portion of the mixture being exhausted from the upper volume via a first flow path passing through at least one gas burner port formed in a cap of the gas burner, a second portion of the mixture being exhausted from the upper volume via a second flow path passing through a slot formed in an upper surface of the body and then through a notch formed in a lower surface of the body of the gas burner, and a third portion of the mixture being exhausted from the upper volume via a gap between a distal end of a side wall of the cap and the upper surface of the body, the cap resting on or above the upper surface; and igniting the second portion of the mixture on exiting the gas burner through the notch, thereby subsequently igniting the first portion of the mixture exiting the gas burner port and the third portion of the mixture exiting the gap.

BRIEF DESCRIPTION OF THE DRAWINGS

Preferred embodiments are disclosed and described in detail herein with reference to the accompanying drawings which form a part hereof, and wherein.

DETAILED DESCRIPTION OF PREFERRED EMBODIMENTS

Figure 1:
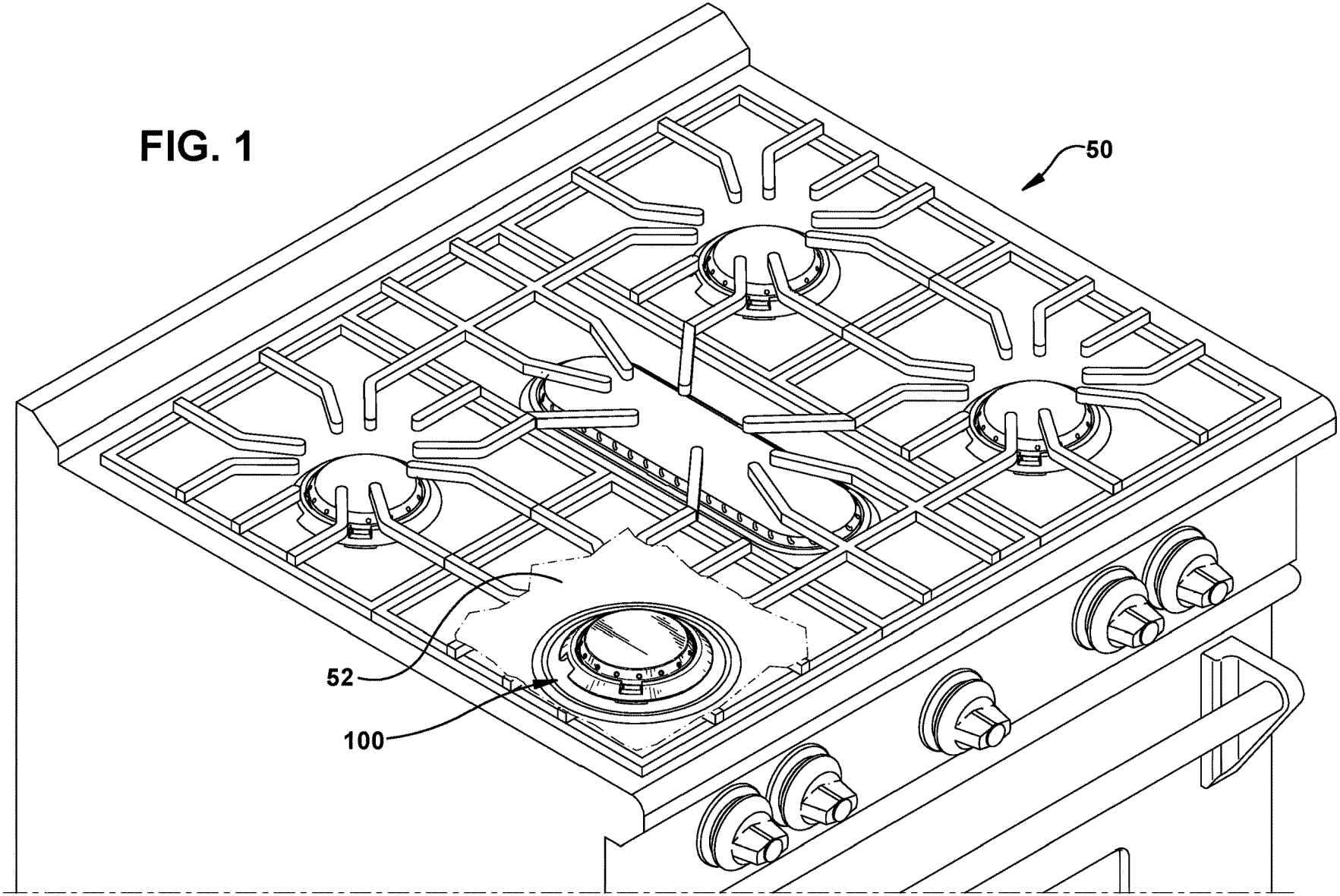
FIG. 1 is a perspective view of a gas range having a plurality of gas burners disposed thereon.

Referring now to the drawings, FIG. 1 shows a gas cooktop appliance in the form of a domestic range, indicated generally at 50. Although the detailed description that follows concerns a domestic range 50, the burners described herein can be incorporated into gas cooktop ranges other than a domestic range 50, as well as in stand-alone gas cooktops (or hobs) that are designed to be mounted on a countertop and not as part of a full range.

Figure 2:
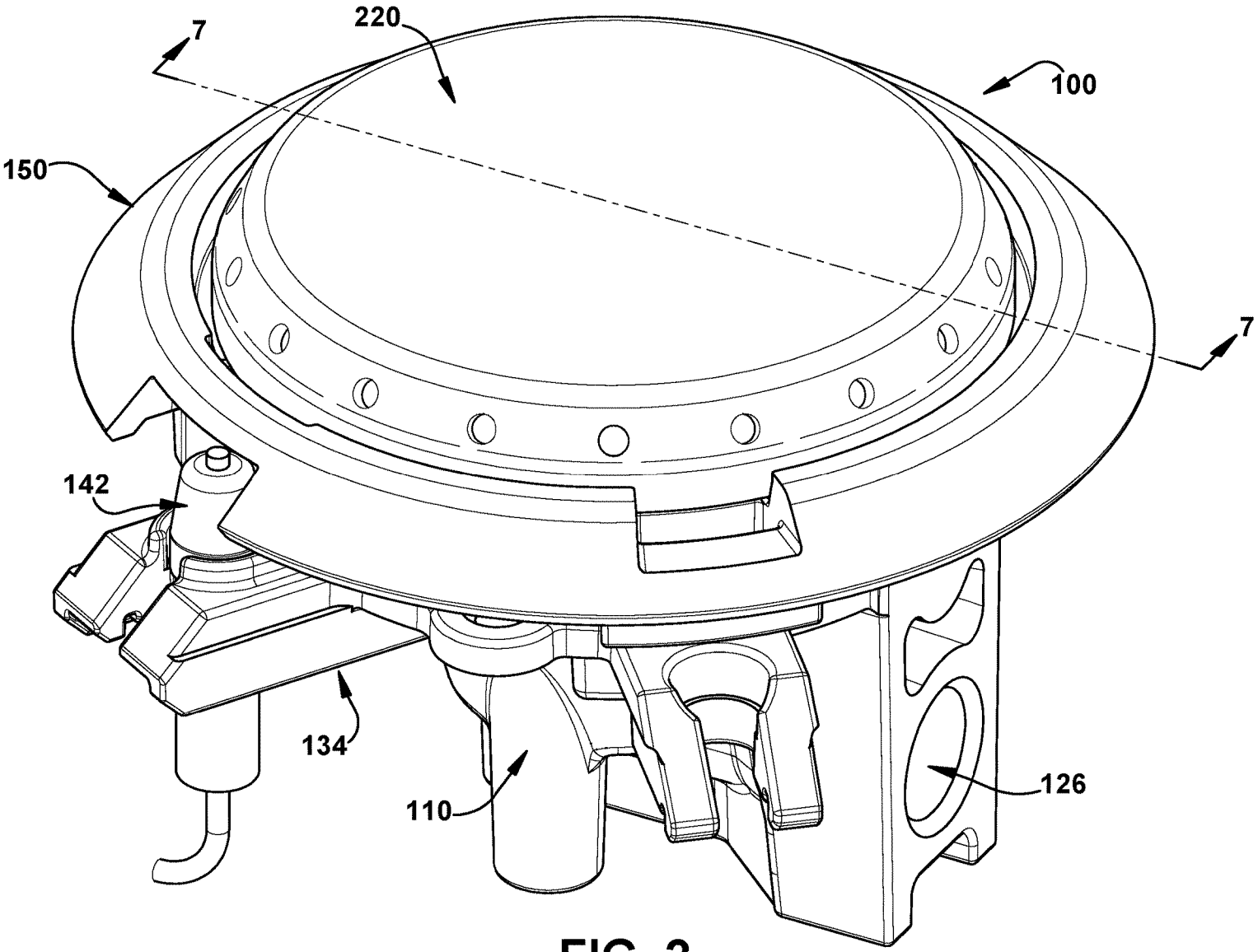
FIG. 2 is a perspective view of an example gas burner as seen in the range of FIG. 1, according to a first embodiment.
Figure 3:
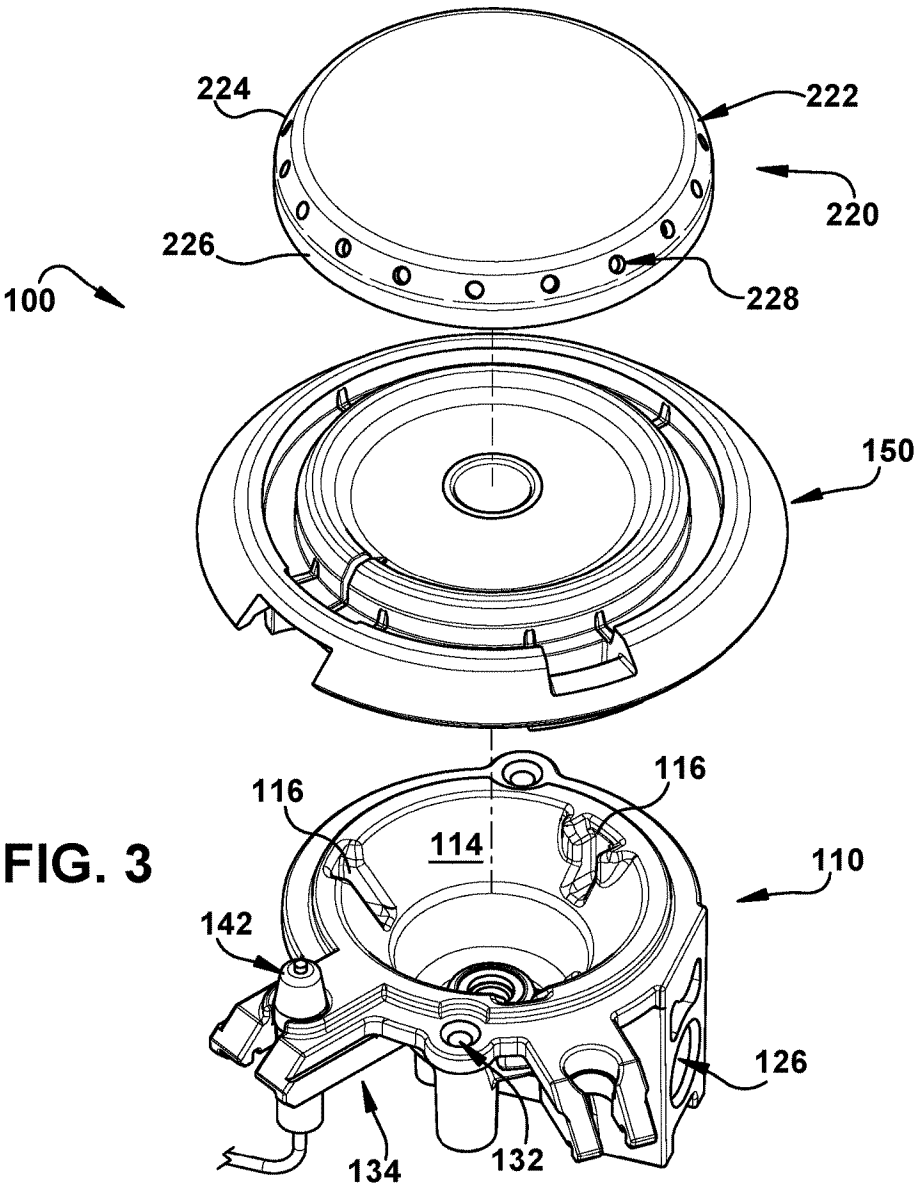
FIG. 3 is an exploded, perspective view of the gas burner of FIG. 2.

FIGS. 1 to 10 illustrate a first embodiment. In this embodiment the range 50 includes a circular gas burner 100. Referring to FIGS. 2 and 3, the gas burner 100, in general, includes an orifice holder 110, a base 150 and a cap 220.

Figure 4:
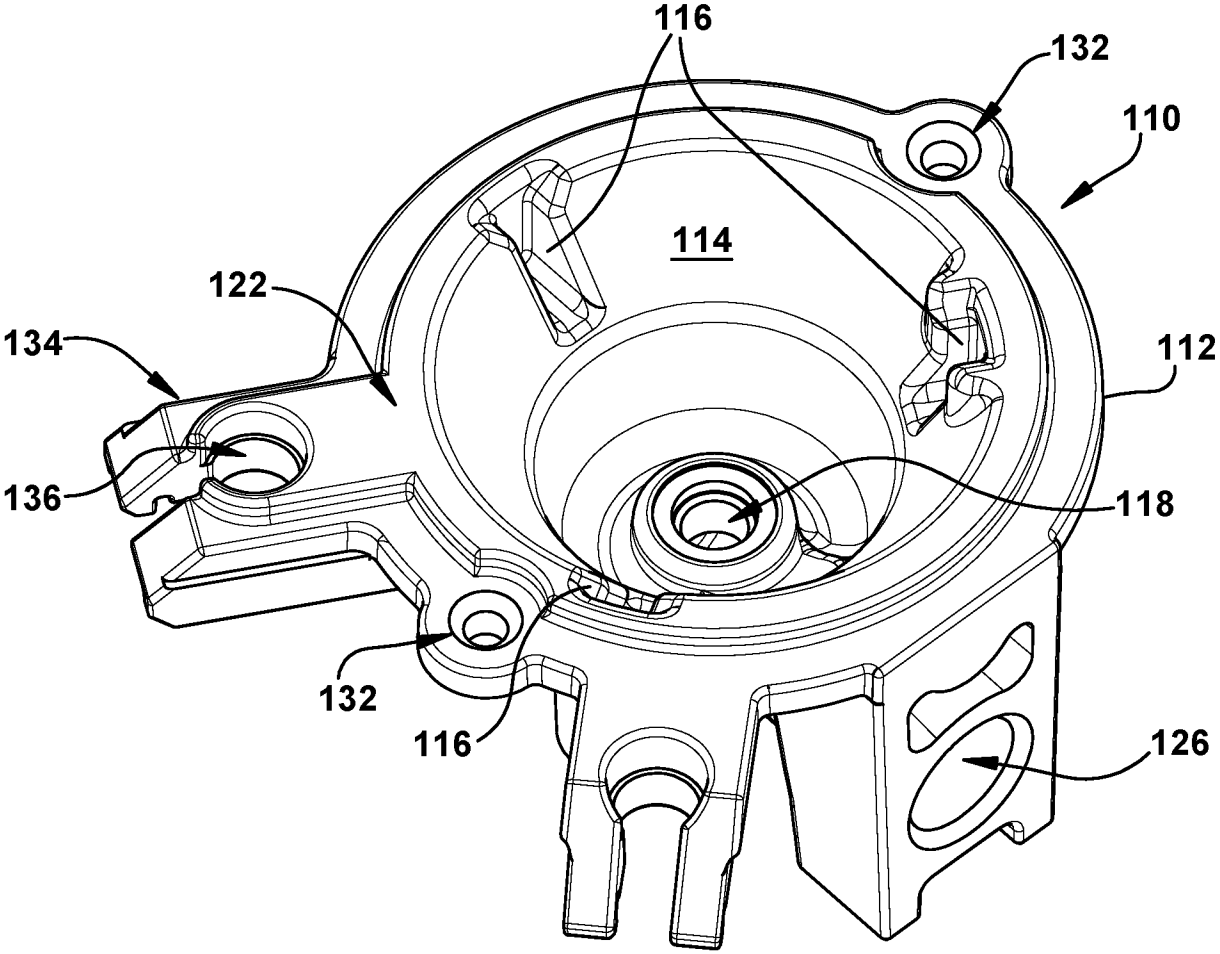
FIG. 4 is a perspective view of a orifice holder of the gas burner of FIGS. 2 and 3.

Referring to FIG. 4, the orifice holder 110 includes a body 112 having a contoured bowl 114 and a gas inlet port 126. The contoured bowl 114 is formed in an upper surface of the body 112. A plurality of seats 116 are formed in a side wall of the bowl 114. The seats 116 are positioned and dimensioned to engage with the base 150, as described in detail below. A port 118 extends through a bottom of the bowl 114. The port 118 is dimensioned to receive a gas nozzle (not shown). The port 118 is fluidly connected by an internal passage 124 (FIG. 7) to the gas inlet port 126.

A contoured opening (not shown) is formed in a cooktop panel 52 (FIG. 1) of the range 50. The opening is contoured to receive a similarly contoured portion 122 of the body 112. In the embodiment shown, the orifice holder 110 is positioned below the cooktop panel 52 such that the contoured portion 122 of the body 112 extends through the opening in the cooktop panel 52. A plurality of mounting holes 132 are formed in the body 112 for securing the orifice holder 110 to the cooktop panel 52. The plurality of mounting holes 132 are dimensioned and positioned to align with mating holes (not shown) in the range 50 cooktop so that fasteners, e.g. screws (not shown) may extend through the cooktop panel 52 and thread into the plurality of holes 132 thereby securing the body 112 to the underside of the cooktop.

A tab 134 extends from one side of the body 112 and includes an opening 136 therein for receiving a spark ignitor 142 (FIG. 2). The spark ignitor 142 is connected to the range 50 and is configured to generate a spark upon command to ignite the burner 100.

Figure 6:
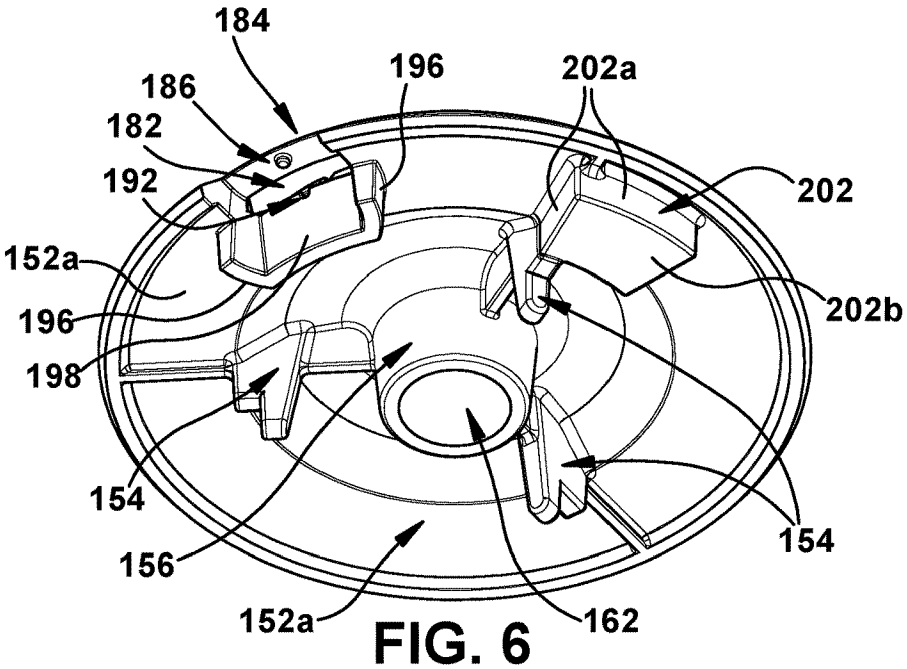
FIG. 6 is a bottom perspective view of the base of FIG. 5.
Figure 5:
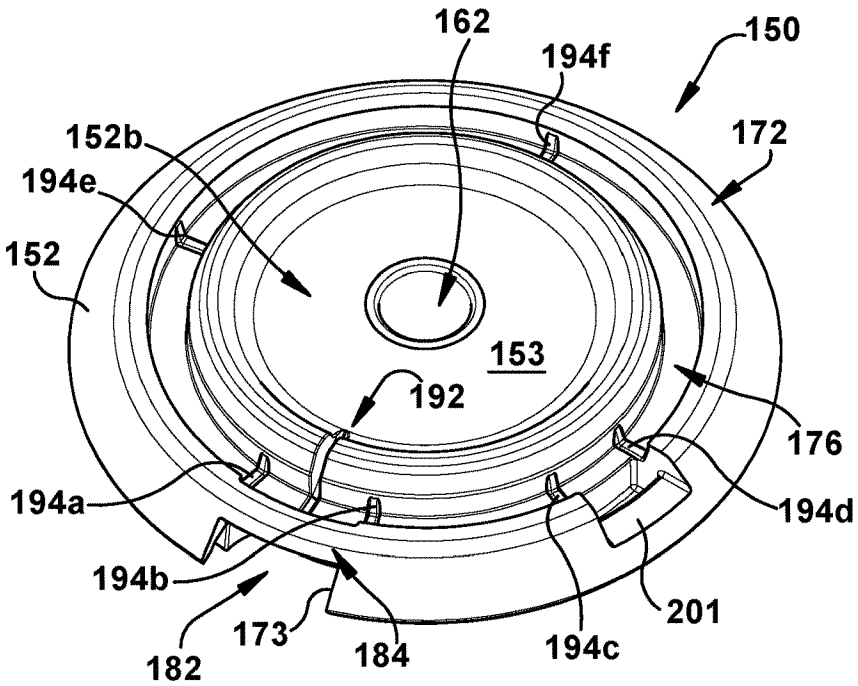
FIG. 5 is a top perspective view of a base of the gas burner of FIGS. 2 and 3.
Figure 7:
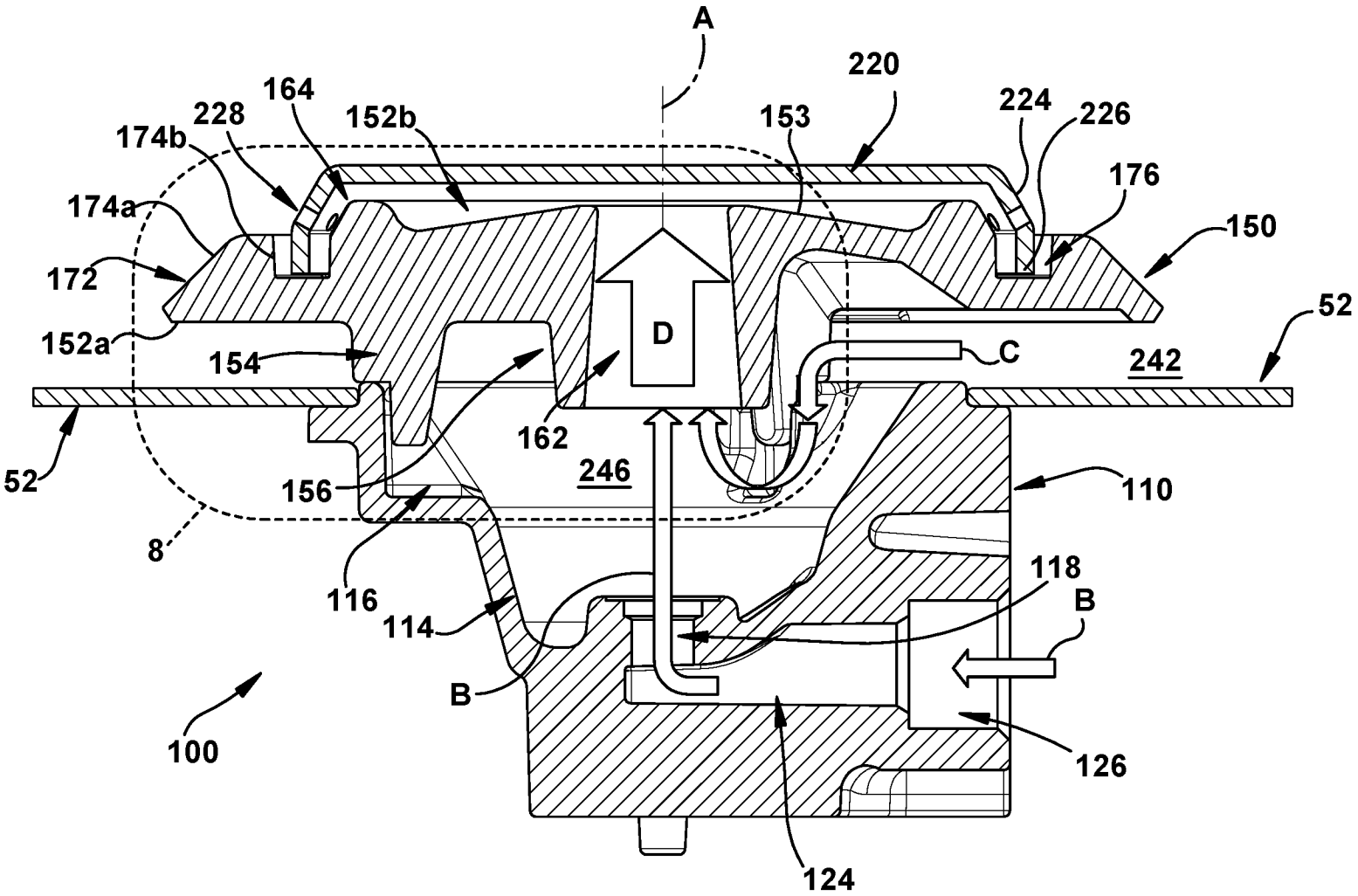
FIG. 7 is a cross section view taken alone line 7-7 of FIG. 2.

Referring to FIGS. 5-7, the base 150 includes a body 152 that is generally disc shaped. Legs 154 extend from a lower surface 152*a* of the body 152. The legs 154 are dimensioned and positioned to align with the seats 116 (FIG. 4) in the orifice holder 110. In the embodiment shown, there are three legs 154 each including a projecting portion. It is contemplated that more than three legs 154 may extend from the lower surface 152*a* and the legs 154 may have other shapes configured for supporting the base 150 on the orifice holder 110.

Referring to FIG. 7, an opening 162 extends through the body 152 from the lower surface 152*a* to an upper surface 152*b* of the body 152. A boss 156 extends from the lower surface 152*a* of the body 152 and the opening 162 extends through the boss 156. In the embodiment shown, the opening 162 has a diameter that increases from a first diameter at the upper surface 152*b* to second, larger diameter at the bottom end of the boss 156. The opening 162 is positioned to axially align with a central axis "A" of the body 152.

A raised annular band 164 is formed in the upper surface 152*b* of the body 152. The raised annular band 164 is generally circular in shape and surrounds the opening 162. A central portion 153 of the upper surface 152*b* bounded between the opening 162 at its center and the raised annular band 164 defining its perimeter is conical-in-shape and slopes downward in direction radially outward from the opening 162.

An upwardly extending flange 172 is disposed about an outer periphery of the body 152 of the base 150. In the embodiment shown, the flange 172 includes a sloped outer wall 174*a* and a generally vertical inner wall 174*b*. A recess 176 is formed between the raised annular band 164 and the vertical inner wall 174*b* of the flange 172. In the embodiment shown, the recess 176 is annular in shape.

Referring to FIG. 5, the flange 172 includes a first notch 173 that defines an opening 182 that communicates with the recess 176. A bridge 184 extends over the opening 182 and includes a spark target 186 on a bottom surface of the bridge 184. The spark target 186 is positioned on the underside surface of the bridge 184 as described in detail below. The opening 182 is positioned to align with a slot 192 formed in the raised annular band 164 and the recess 176. A pair of stand-offs 194*a*, 194*b* are positioned on either side of the slot 192. In the embodiment shown, the stand-offs 194*a*, 194*b* are on opposite sides of the first notch 173 and align with the edges of the opening 182. A plurality of downwardly extending walls 196, 198 (FIG. 6) extend from the lower surface 152*a* of the body 152 around the opening 182.

The flange 172 includes a second notch 201 that is positioned above a stability chamber 202. The stability chamber 202 is formed as a recessed cavity that extends from the lower surface 152*a* of the body 152. In the embodiment shown, the stability chamber 202 is generally box-shaped with side walls 202*a* and a bottom wall 202*b*. Stand-offs 194*c*, 194*d* are positioned on opposite sides of the second notch 201. In the embodiment shown, the stand-offs 194*c*, 194*d* are on opposite sides of the second notch 201 and are aligned with the edges of the stability chamber 202.

Stand-offs 194*e*, 194*f* are positioned in the lower wall of the recess 176 at spaced-apart locations. The stand-offs 194*a*, 194*b*, 194*c*, 194*d*, 194*e*, 194*f* are dimensioned as described in detail below.

Referring to FIG. 3, the cap 220 is dimensioned to rest on the base 150. The cap 220 is a generally disc-shaped element having a downwardly extending peripheral side wall 222. The peripheral side wall 222 has a sloped upper portion 224 and a lower portion 226. A plurality of gas burner ports 228 is disposed in the sloped upper portion 224 of the cap 220.

Referring to FIG. 7, the gas burner 100 is assembled by first securing the orifice holder 110 to a lower surface of the cooktop panel 52 of the range 50. It is contemplated that a plurality of fasteners (not shown) may be used to secure the orifice holder 110 to the cooktop panel 52. The gas nozzle (not shown) is disposed in the port 118 in the bottom of the orifice holder 110. A gas supply line (not shown) is attached to the gas inlet port 126.

The base 150 is then placed on the orifice holder 110. In particular, the legs 154 of the base 150 are dimensioned and positioned to align with the seats 116 in the orifice holder 110. When the base 150 is positioned on the orifice holder 110, the lower surface 152*a* of the base 150 is spaced above the upper surface of the cooktop panel 52 to define a circumferential air inlet 242 between the lower surface 152*a* of the base 150 and the upper surface of the cooktop panel 52. The opening 162 in the base 150 is also positioned to align with the port 118 in the orifice holder 110.

Figure 8:
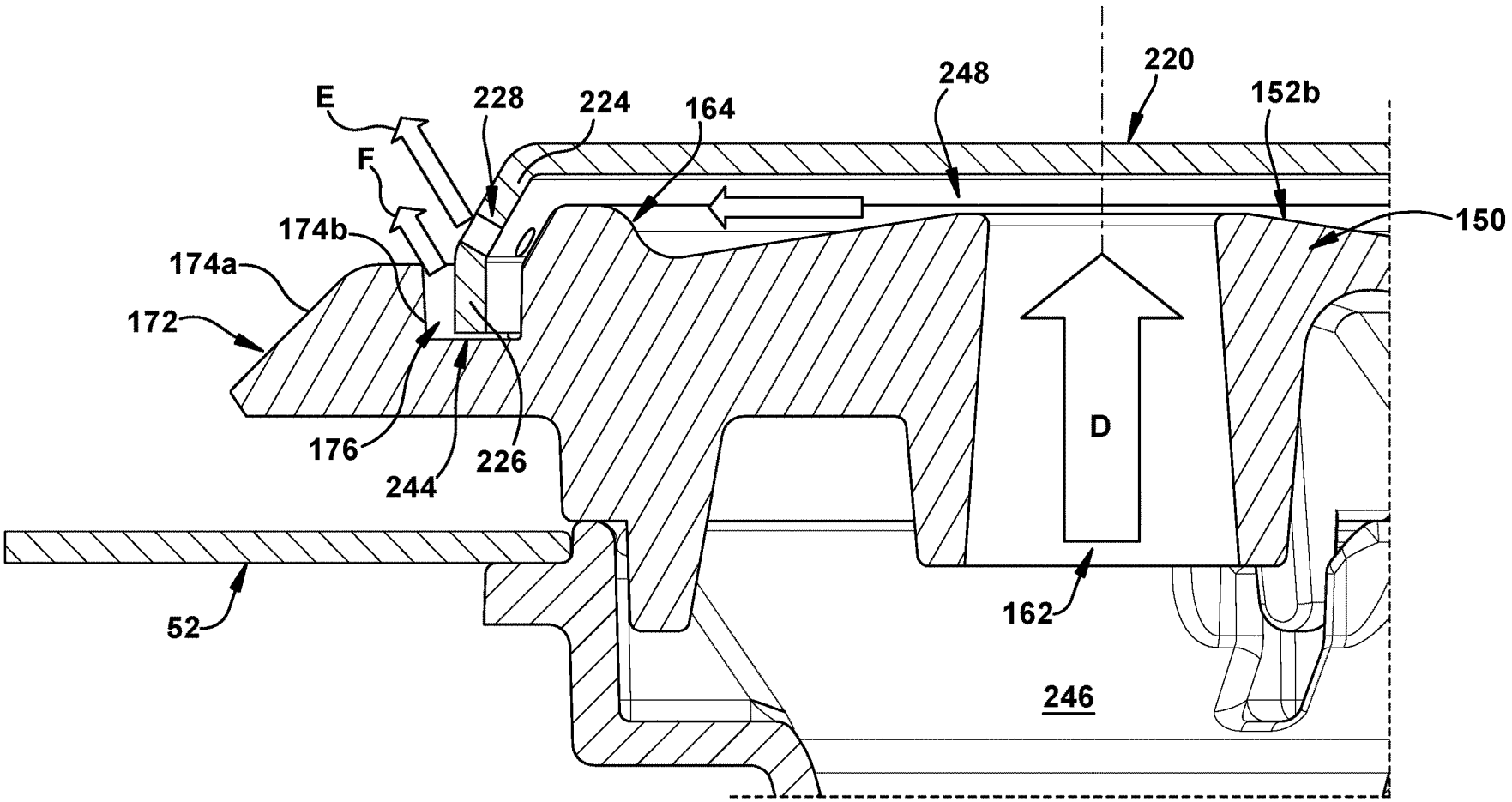
FIG. 8 is an enlarged view delimited by the broken-line circle marked 8 from FIG. 7.

Referring to FIG. 8, the cap 220 is placed on the base 150. In particular, the lower portion 226 of the cap 220 extends into the recess 176 formed in the upper surface 152*b* of the base 150. A lower peripheral edge of the lower portion 226 of the cap 220 rests on the plurality of stand-offs 194*a*, 194*b*, 194*c*, 194*d*, 194*e* (FIG. 5) such that a gap 244 is formed between the lower peripheral edge of the lower portion 226 of the cap 220 and the bottom wall of the recess 176.

The gas burner 100 will now be described with respect to the operation of the gas burner 100. When the gas burner 100 is assembled, as described above, the orifice holder 110 and the base 150 define a lower mixing chamber or mixing volume 246 (FIG. 7) therebetween. Separately, the cap 220 and the base 150 define an upper volume 248 (FIGS. 7 and 8) therebetween. Referring to FIG. 7, fuel (e.g. a combustible gas such as natural gas) fed from the gas inlet port 126 enters the lower mixing volume 246 via the gas nozzle (not shown) in the bottom of the bowl 114 of the orifice holder 110 along flow path B. The gas passes through the gas nozzle (not shown) and is ejected into the lower mixing volume 246 where it mixes with combustion air. The combustion air is drawn into the lower mixing volume 246 along flow path C via the circumferential air inlet 242 via a venturi effect.

Referring to FIG. 8, the air/fuel mixture is delivered into the upper volume 248 along flow path D via the opening 162, and exits the upper volume 248 along flow path E via gas burner ports 228 disposed at the periphery of the cap 220. The air/fuel mixture also exits the upper volume 248 along flow path F via the gap 244 between the lower peripheral edge of the cap 220 and the base 150. The gas burner ports 228 are illustrated as a plurality of circular burner ports that are formed in the sloped upper portion 224 of the cap 220. It is contemplated that the gas burner ports 228 could have other shapes, for example, but not limited to, U-shaped, slanted slits, etc.

Figure 9:
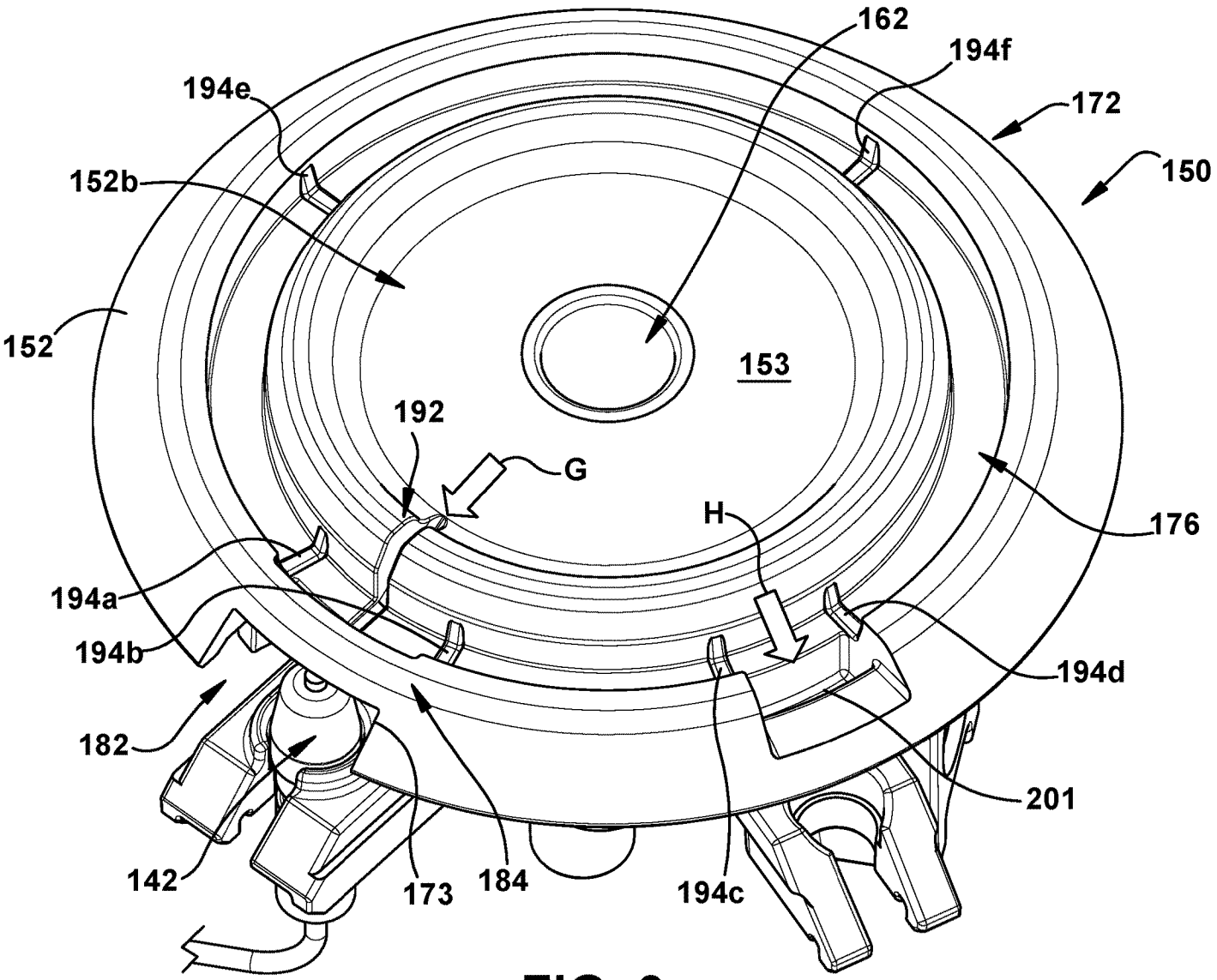
FIG. 9 is a top perspective view of a base of the gas burner of FIGS. 2 and 3 with a cover of the gas burner removed.
Figure 10:
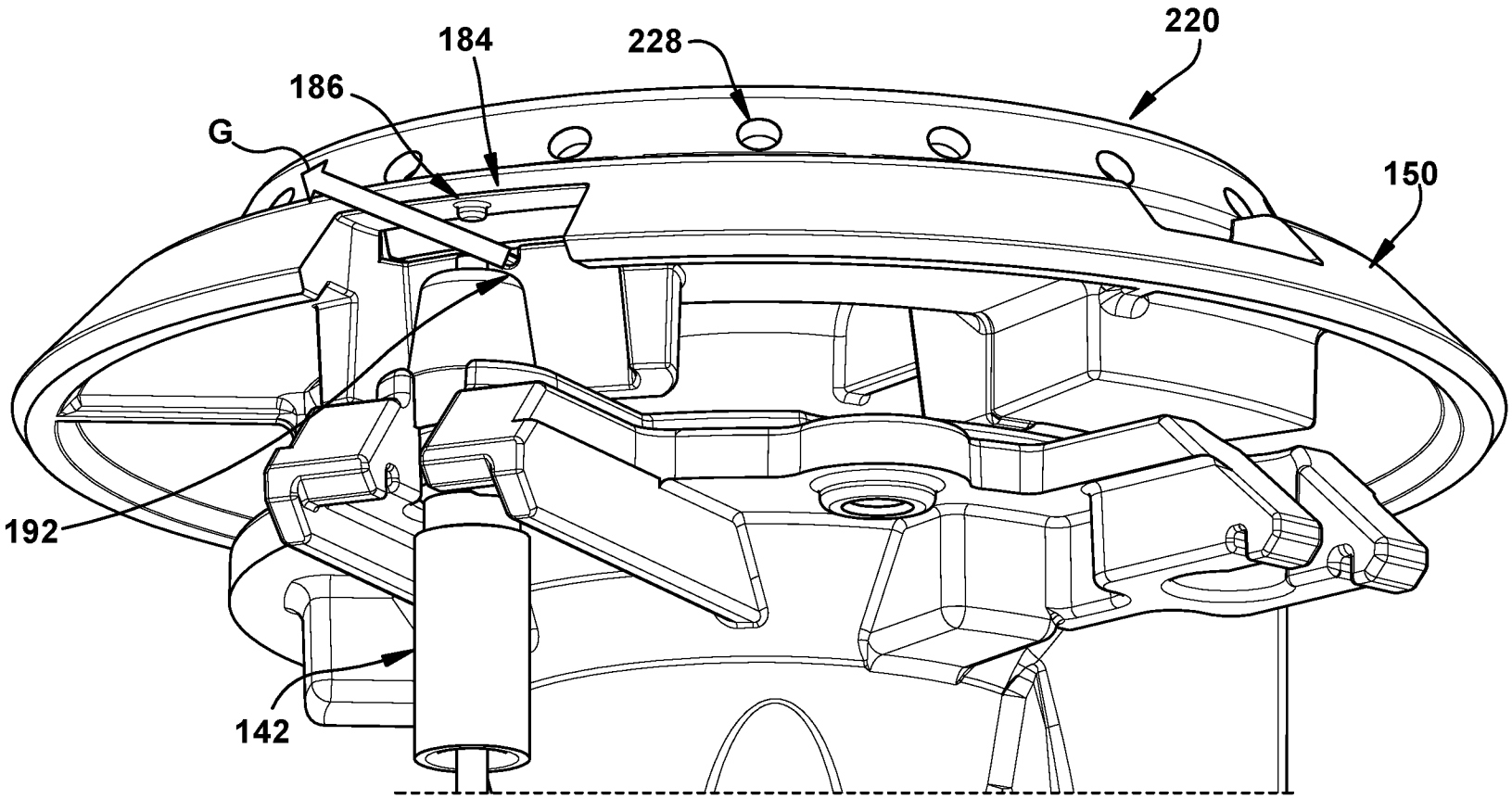
FIG. 10 is a bottom perspective view of the gas burner of FIGS. 2 and 3.

Referring to FIG. 9 (wherein the cap 220 is removed for clarity) a portion of the air/fuel mixture also flows along flow path G through the slot 192 in the raised annular band 164. This portion of the air/fuel mixture is directed at the spark ignitor 142, which ignites it to generate a flame. The spark ignitor 142 ignites the flame by directing a spark at the spark target 186 (FIG. 10) disposed on and protruding from the bottom surface of the bridge 184. The flame then ignites the portion of the air/fuel mixture exiting through the gap 244 (FIG. 8) to form a "curtain" flame emanating from and substantially about the perimeter of the lower peripheral edge of the cap 220. This curtain flame is in addition to the main flames that exit from the gas burner ports 228. The curtain flame is a "carry-over" flame that connects or joins adjacent main flames. The curtain flame helps in re-igniting the main flames during accidental "blow-out," as explained below.

Another portion of the air/fuel mixture is also directed along flow path H (FIG. 9) toward the stability chamber 202. This portion of the air/fuel mixture fills the stability chamber 202 and creates a separate stability flame, described in detail below.

In normal operation, the composition and pressure of the air/fuel mixture will be equal in both the stability chamber 202 and the upper volume 248. Accordingly, the stability chamber 202, the gas burner ports 228 and the gap 244 about the entire perimeter of the cap 220 will be fed continuously to sustain their respective flames. However, because the burner 100 is a top-breather that draws combustion air from the ambient environment, momentary or transient pressure waves resulting from activities in the room can impact the supply of combustion air to the burner 100, especially at low turn-down. For example, opening or closing a door or activation of an HVAC system can generate instantaneous pressure waves sufficient to disrupt the flow of combustion air so as to extinguish flames.

The stability chamber 202 is at least partially isolated from the remaining upper volume 248 such that the aforementioned pressure wave is impeded from impacting the gas pressure in, and therefore the instantaneous flow characteristics of, gas resident in the stability chamber 202. In addition, the stability chamber 202 stores a small excess of the combustion mixture, which may continue burning during transient pressure effects that otherwise will extinguish the flames from gas burner ports 228 and the gap 244. As a result, combustion of the air/fuel mixture to produce the stability flame from the stability chamber 202 may be substantially unaffected by instantaneous, transient pressure waves that may otherwise 'blow out' the port flames. Thereafter, once the steady flow of air/fuel mixture is restored to gas burner ports 228 and the gap 244 the stability flame sustained from the stability chamber 202 may reignite the remaining gas burner ports 228 and gap 244 resulting in substantially uninterrupted flame performance. During the reigniting of the gas burner ports 228 and gap 244, the curtain flame from the gap 244 spans the gap between adjacent gas burner ports 228 to "carry" the flame from one gas burner port 228 to adjacent gas burner ports 228. It is contemplated that the curtain flame may be continuous about the entire periphery of the cap 220 or the curtain flame may be segmented and exist only between adjacent gas burner ports 228.

According to another embodiment, the burner 100 may be part of a burner assembly 300. See, FIG. 11. The burner assembly 300 may include burners 310A, 310B similar or identical to burner 100. Accordingly, the burners 310A, 310B will not be described in detail herein.

Figure 11:
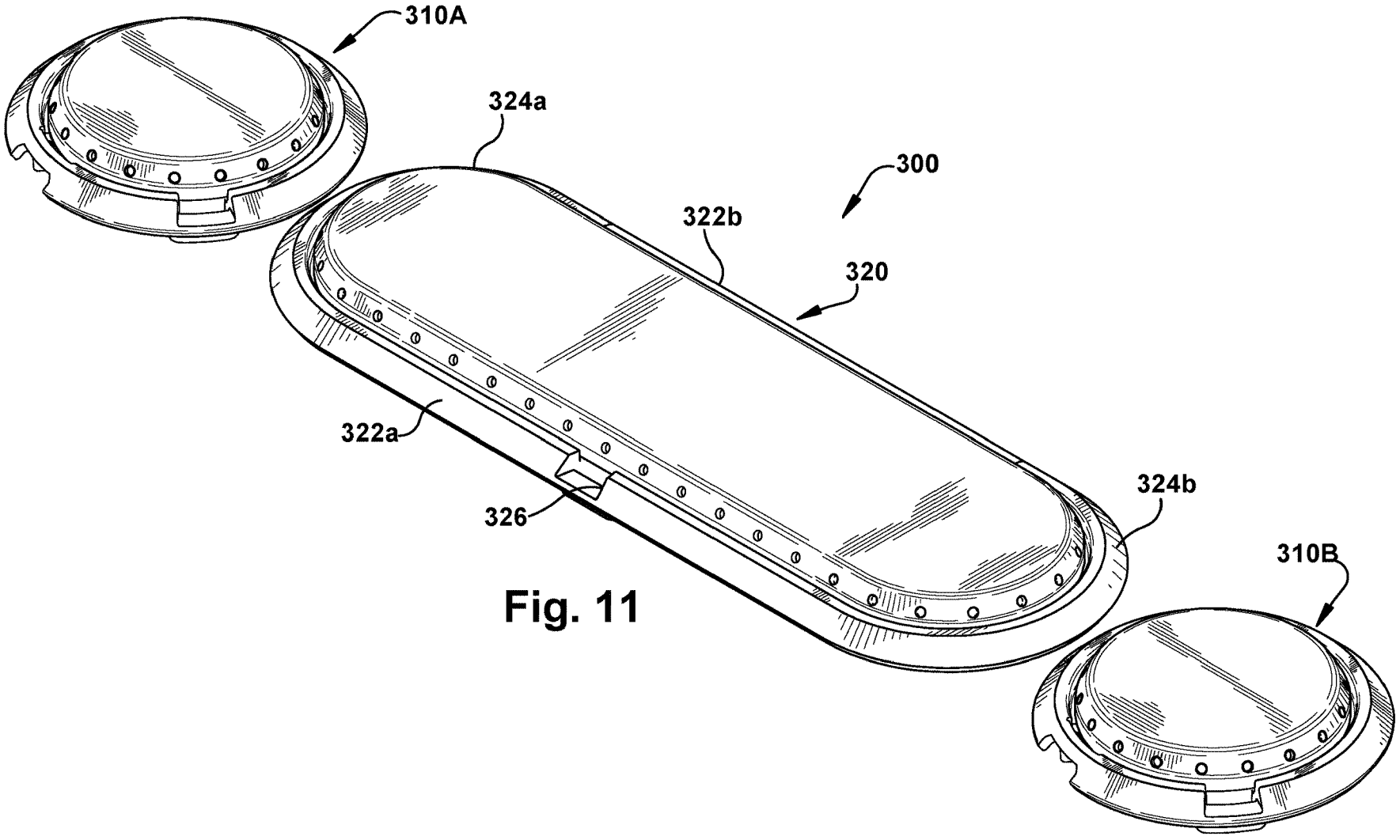
FIG. 11 is a top perspective view of gas burner assembly, according to a second embodiment.

A third burner, burner 320 may be positioned between the burners 310A, 310B. The burner 320 is similar in most respects to burner 100, except burner 320 is elongated, i.e., it has parallel sides 322*a*, 322*b* that are disposed and extend between opposing semicircular portions 324*a*, 324*b*. As illustrated in FIG. 11, the parallel side 322*a* is notched to define an opening 326 that is positioned proximate a spark ignitor, similar to the opening 182 of burner 100. The parallel side 322*b* is also notched (not shown) to define a location for a stability chamber, similar to the stability chamber 202 of burner 100.

It is contemplated that burners 310A, 310B, 320 may be individually operated. For example, for cooking the contents of a standard pot, only one of the circular burners 310A, 310B might be activated. On the other hand, to cook or warm the contents of an elongated pan or casserole dish, all three burners 310A, 310B, 320 may be activated to create a generally elongate cooking zone. If the pan is relatively short, only the third (central) burner 320 or only it and one of the circular burners 310A, 310B at either end need be activated. Optionally, a subset of the three burners 310A, 310B, 320 (more than one) can be actuated together via a common controller via a single control input. The burners 310A, 310B, 320 can be controlled and configured using otherwise conventional or suitable features for operating gas or electric burners.

Figure 12A:
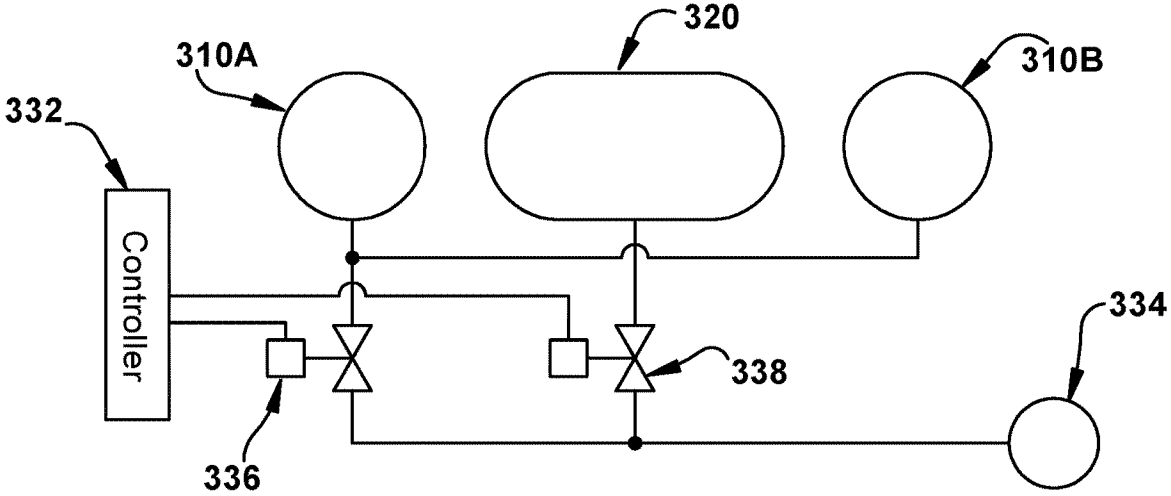
FIGS. 12A-12B are schematic diagrams illustrating various valve arrangements for the gas burner assembly of FIG. 11.
Figure 12B:
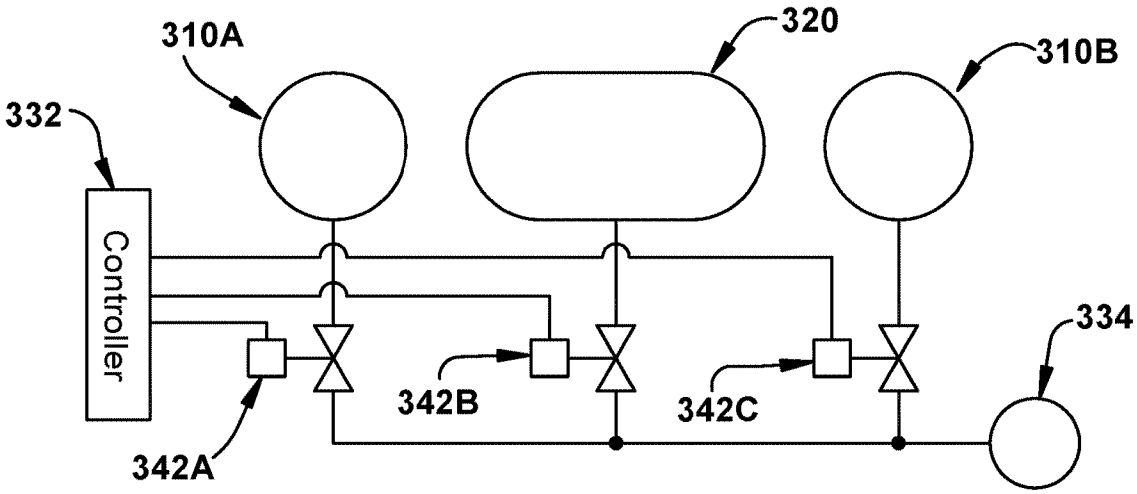
Figure 13:
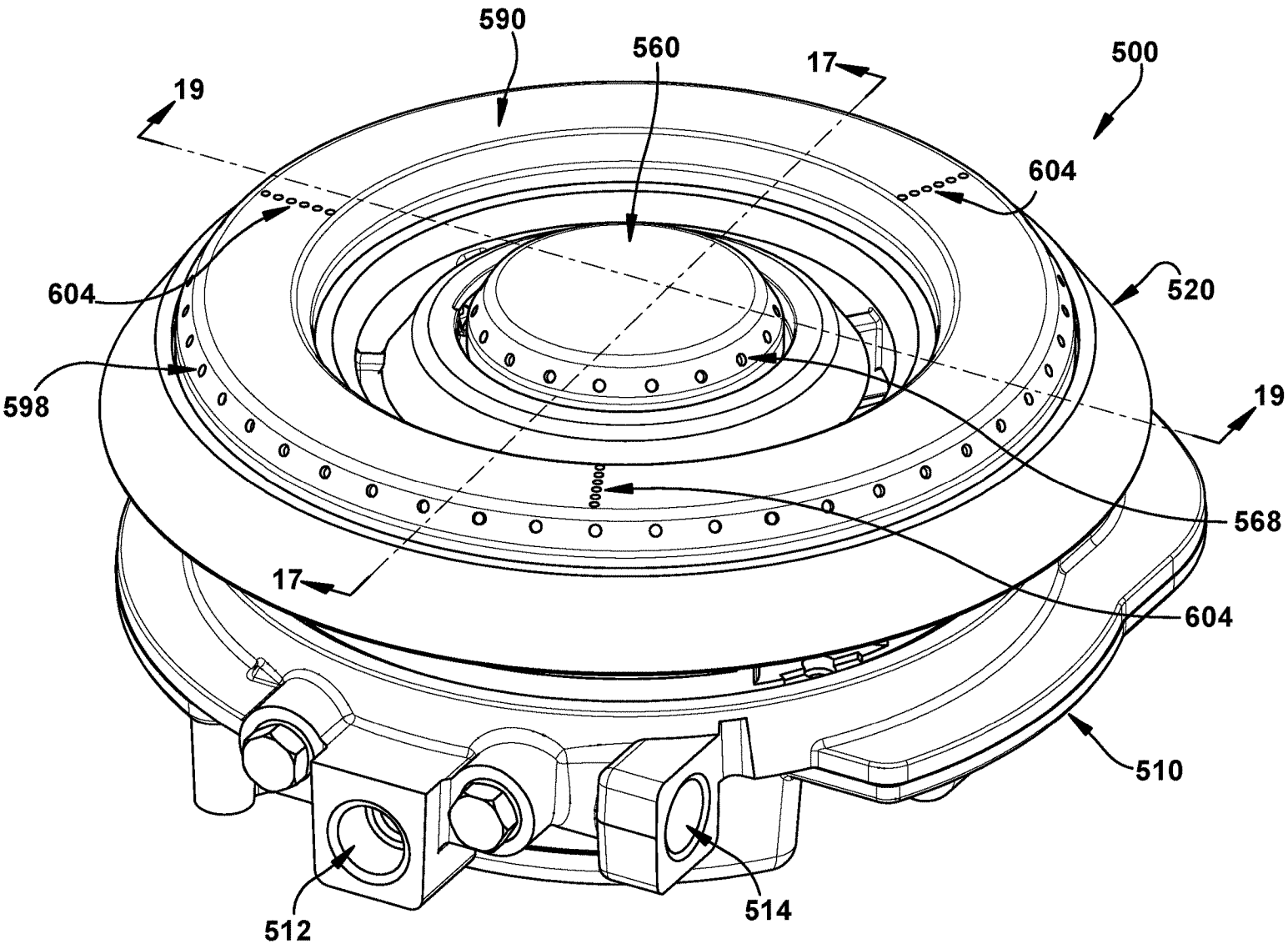
FIG. 13 is a top perspective view of a gas burner, according to a third embodiment.

Referring to FIG. 12A, a controller 332 may control a valve 336 and a valve 338 for supplying fuel from a source 334 to the burners 310A, 310B, 320. The valve 336 controls the flow of fuel to the burners 310A, 310B and the valve 338 controls the flow of fuel to the burner 320. Referring to FIG. 12B, optionally, the controller 332 may also control three valves 342A, 342B, 342C for supplying fuel from the source 334 to the burners 310A, 310B, 320, respectively. In particular, flow to each burner 310A, 310B, 320 may be individually controlled by a separate valve 342A, 342B, 342C.

FIGS. 13-19 illustrate a gas burner 500, accordingly to a third embodiment. The gas burner 500, in general, includes an orifice holder 510, a base 520, an inner cap 560, and an outer cap 590.

Figure 14:
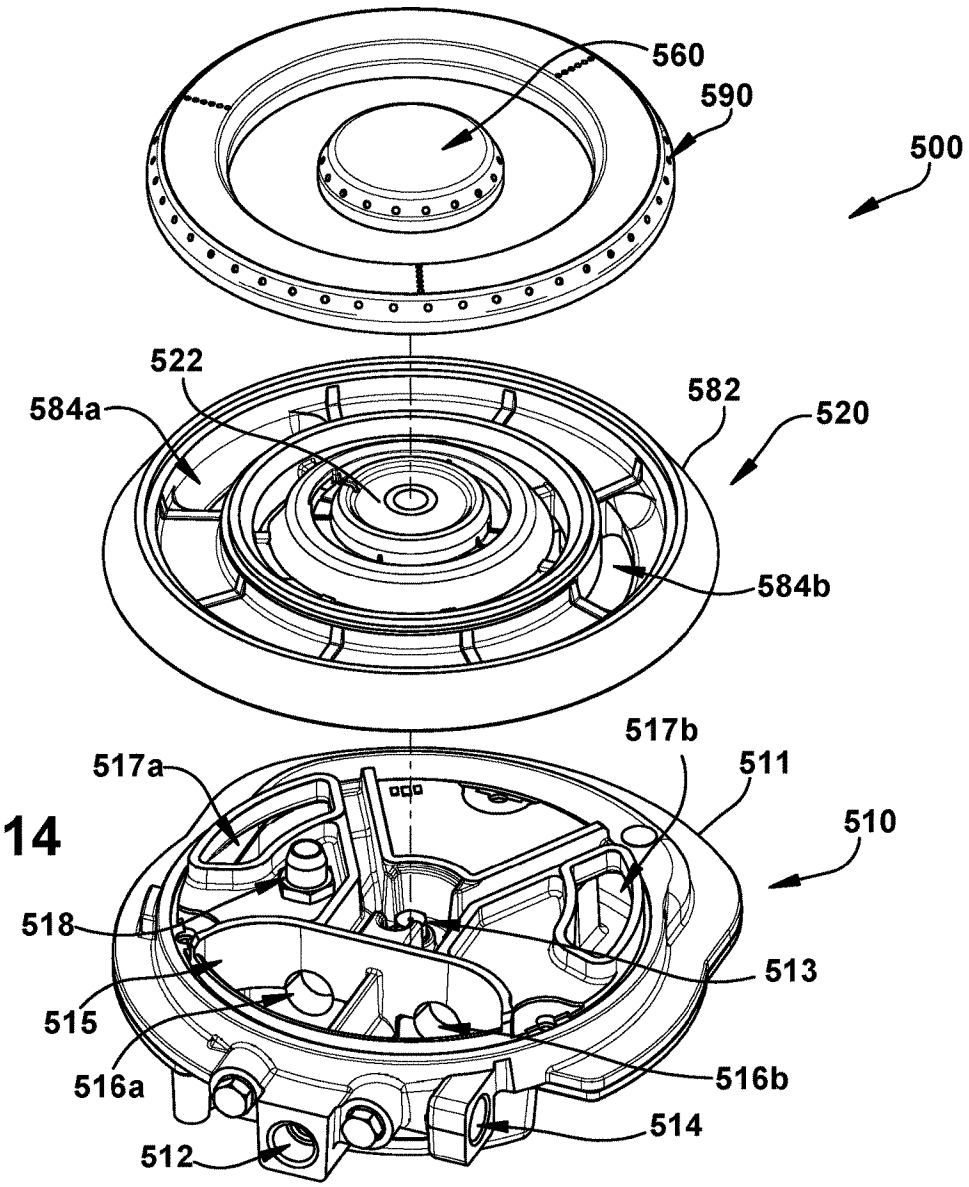
FIG. 14 is an exploded perspective view of the gas burner of FIG. 13.

Referring to FIG. 14, the orifice holder 510 includes a body 511 having a first gas inlet port 512 and a second gas inlet port 514 formed therein. The first gas inlet port 512 fluidly connects to a first nozzle 513 that is positioned near a central portion of the body 511. The first nozzle 513 is oriented in a vertical direction for ejecting a fuel in the vertical direction from the body 511.

The second gas inlet port 514 fluidly connects to two nozzles (not shown) that are attached to the body 511. The two nozzles are oriented in a horizontal direction for directing a fuel through a cavity 515 and to two horizontal passages 516*a*, 516*b* in the body 511. The cavity 515 is fluidly connected to the surrounding environment for drawing ambient air into the two horizontal passages 516*a*, 516*b* via a Venturi effect. The air/fuel mixture from the passages 516*a*, 516*b* is then ejected in a vertical direction through a first outlet port 517*a* and a second outlet port 517*b*, respectively. A spark ignitor 518 extends in a vertical direction from the surface of the body and is positioned as described in detail below.

Figure 15:
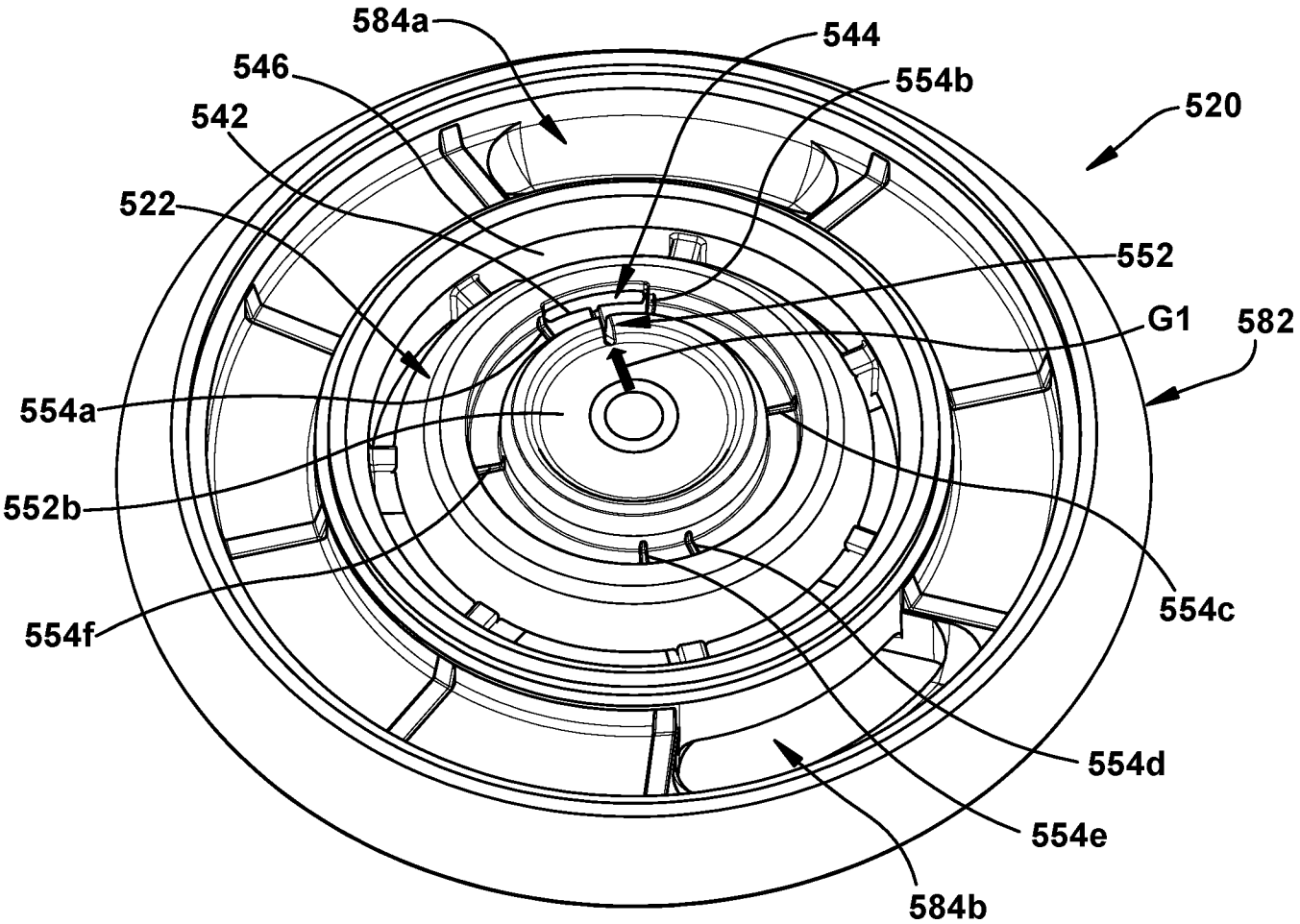
FIG. 15 is a top perspective of a base of the gas burner of FIG. 13.
Figure 16:
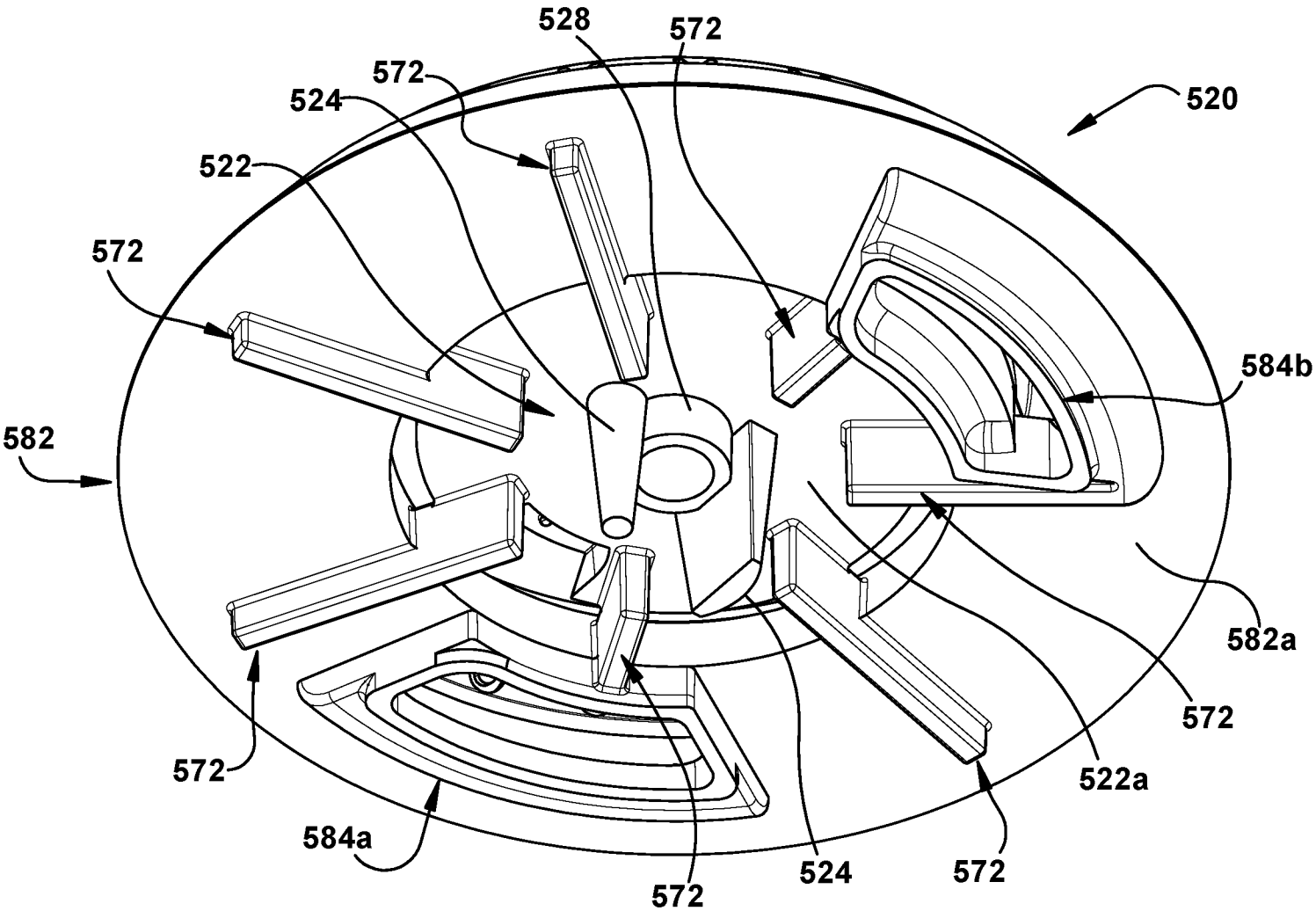
FIG. 16 is bottom perspective view of the base of the gas burner of FIG. 13.
Figure 17:
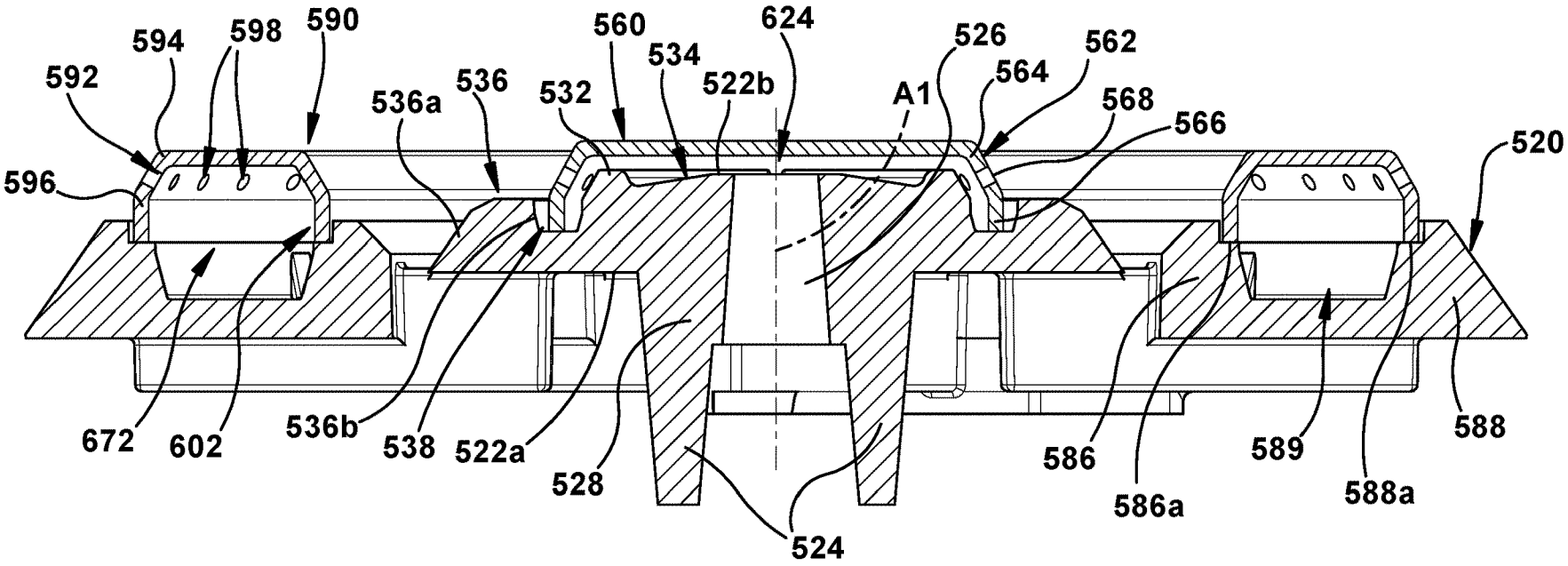
FIG. 17 is a side section view of the gas burner of FIG. 13 taken along line 17-17 of FIG. 13 showing only a base, an inner cap and an outer cap of the gas burner.

The base 520 is configured to be positioned on the orifice holder 510. Referring to FIGS. 15-17, the base 520 includes an inner body 522 and an outer body 582.

The inner body 522 is similar in construction to the body 152 of the base 150, described in detail above. The inner body 522 defines an inner burner portion of the gas burner 500. The inner body 522 is generally disc shaped and includes legs 524 (FIG. 16) extending from a lower surface 522*a* of the inner body 522. The legs 524 are dimensioned and positioned to align with corresponding seats 519 (FIG. 18) in the orifice holder 510. In the embodiment shown, there are two legs 524. It is contemplated that more than two legs 524 may extend from the lower surface 522*a* and that the legs 524 may have other shapes configured for supporting the inner body 522 on the orifice holder 510. The legs 524 and their associated seats 519 in the orifice holder 510 are designed (i.e. keyed) to lock the base 520 relative to the orifice holder 510 so that it cannot rotate relative thereto.

Referring to FIG. 17, a central opening 526 extends through the inner body 522 from the lower surface 522*a* to an upper surface 522*b* of the inner body 522. A boss 528 extends from the lower surface 522*a* of the inner body 522 and the opening 526 extends through the boss 528. In the embodiment shown, the opening 526 has a diameter that increases from a first diameter near the upper surface 522*b* to second, larger diameter near the bottom end of the boss 528. The opening 526 is positioned to axially align with a central axis "A1" of the inner body 522.

A raised annular band 532 is formed in the upper surface 522*b* of the inner body 522. The raised annular band 532 is generally circular in shape and surrounds the opening 526. A central portion 534 of the upper surface 522*b* bounded between the opening 526 at its center and the raised annular band 532 defining its perimeter is conical-in-shape and slopes downward in a direction radially outward from the opening 526.

An upwardly extending flange 536 is disposed about an outer periphery of the inner body 522 of the base 520. In the embodiment shown, the flange 536 includes a sloped outer wall 536*a* and a generally vertical inner wall 536*b*. A recess 538 is formed between the raised annular band 532 and the inner wall 536*b* of the flange 536. In the embodiment shown, the recess 538 is annular in shape.

Referring to FIG. 15, the flange 536 includes a notch 542 that defines an opening 544 that communicates with the recess 538. A bridge 546 extends over the opening 544 and includes a spark target 548 (FIG. 19) on and protruding from a bottom surface of the bridge 546 (best seen in FIG. 15). The spark target 548 is positioned as described in detail below. The opening 544 is positioned to align with a slot 552 formed in the raised annular band 532 and the recess 538. A pair of stand-offs 554*a*, 554*b* are positioned on either side of the slot 552. In the embodiment shown, the stand-offs 554*a*, 554*b* are on opposite sides of the notch 544 and align with the edges of the opening 544.

Stand-offs 554*c*, 554*d*, 554*e*, 554*f* are positioned in the lower wall of the recess 538 at spaced-apart locations. It is contemplated that additional or fewer stand-offs may be formed in the recess 538, as needed. The stand-offs 554*a*, 554*b*, 554*c*, 554*d*, 554*e*, 554*f* are dimensioned as described in detail below.

Referring to FIG. 17, the inner cap 560 is dimensioned to rest on the inner body 522. The inner cap 560 is a generally disc-shaped element having a downwardly extending peripheral side wall 562. The peripheral side wall 562 has a sloped upper portion 564 and a vertical lower portion 566. A plurality of gas burner ports 568 are disposed in the sloped upper portion 564 of the inner cap 560.

Referring to FIG. 16, a plurality of ribs 572 connect the inner body 522 to the outer body 582. The outer body 582 defines an outer burner portion of the burner 500. In the embodiment shown, each rib 572 is generally straight and attaches to the lower surface 522*a* of the inner body 522 and to a lower surface 582*a* of the outer body 582.

Figure 19:
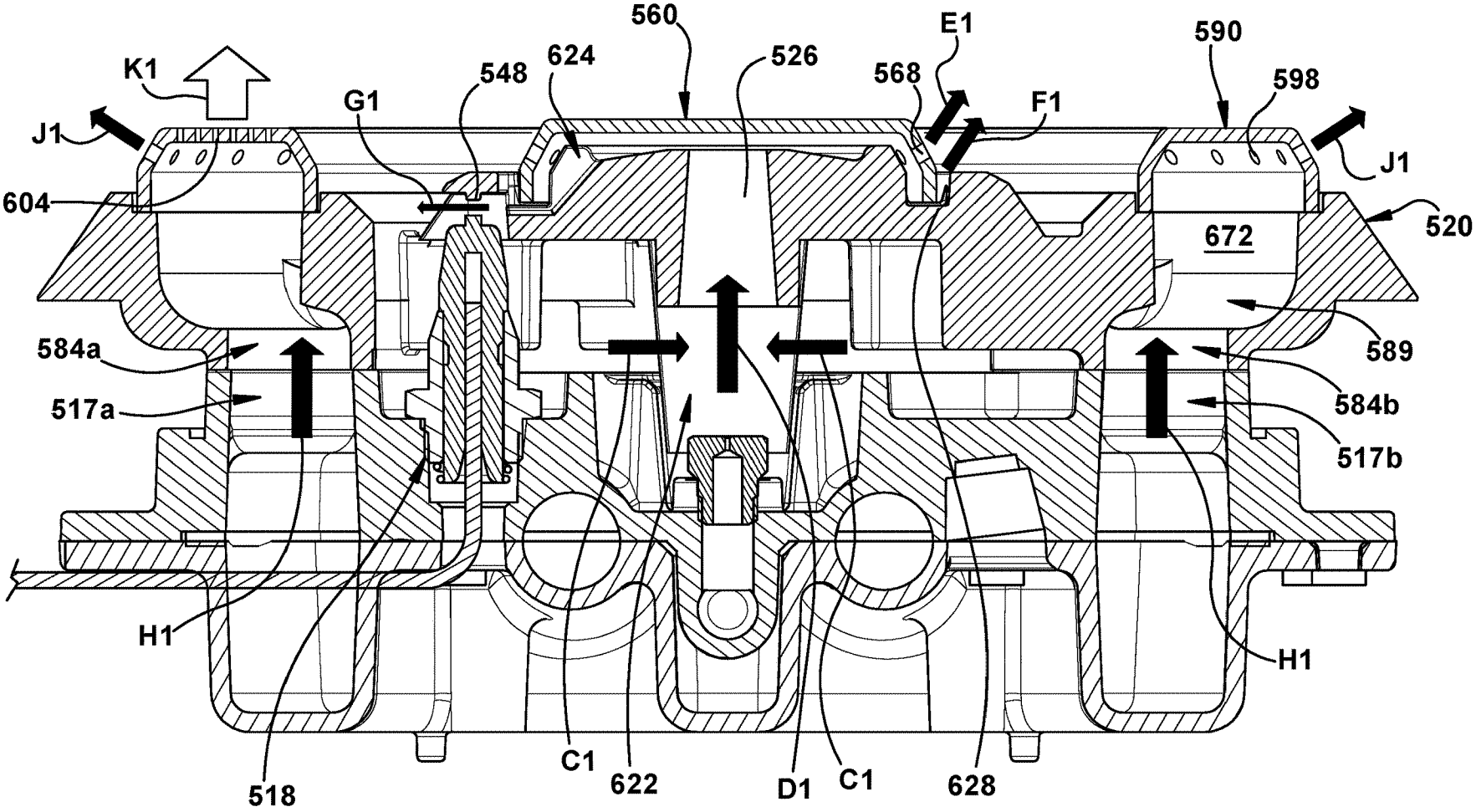
FIG. 19 is a side section view of the gas burner of FIG. 13 taken along line 19-19 of FIG. 13.

Referring back to FIG. 17, the outer body 582 is a generally ring-shaped body with an inner wall 586, an outer wall 588 and a recess 589. The inner wall 586 and the outer wall 588 each include a ledge 586*a*, 588*a*, respectively, for supporting the outer cap 590. The recess 589 is formed between the inner wall 586 and the outer wall 588. As shown in FIG. 19, two inlet ports 584*a*, 584*b* extend from the lower surface 582*a* of the outer body 582 and provide fluid communication to the recess 589 via the bottom wall thereof. The inlet port 584*a* is dimensioned and positioned to align with the first outlet port 517*a* of the orifice holder 510 and the inlet port 584*b* is dimensioned and positioned to align with the second outlet port 517*b* of the orifice holder 510 when the base 520 is positioned on the orifice holder 510, as shown in FIG. 19.

Referring back to FIG. 17, the outer cap 590 is dimensioned to rest on the outer body 582. The outer cap 590 includes a downwardly extending outer wall 592 and downwardly extending inner wall 602. The outer wall 592 has a sloped upper portion 594 and a vertical lower portion 596. A plurality of gas ports 598 are disposed in the sloped upper portion 594 of the outer wall 592. The lower distal ends of the outer wall 592 and of the inner wall 602 are dimensioned to rest on the respective ledges 586*a*, 588*a* of the outer body 582. Three radially extending rows of gas ports 604 (FIG. 13) are spaced-apart circumferentially on the upper surface of the outer cap 590. In the embodiment shown, the rows of gas ports 604 are equally spaced 120° apart in the outer cap 590.

Figure 18:
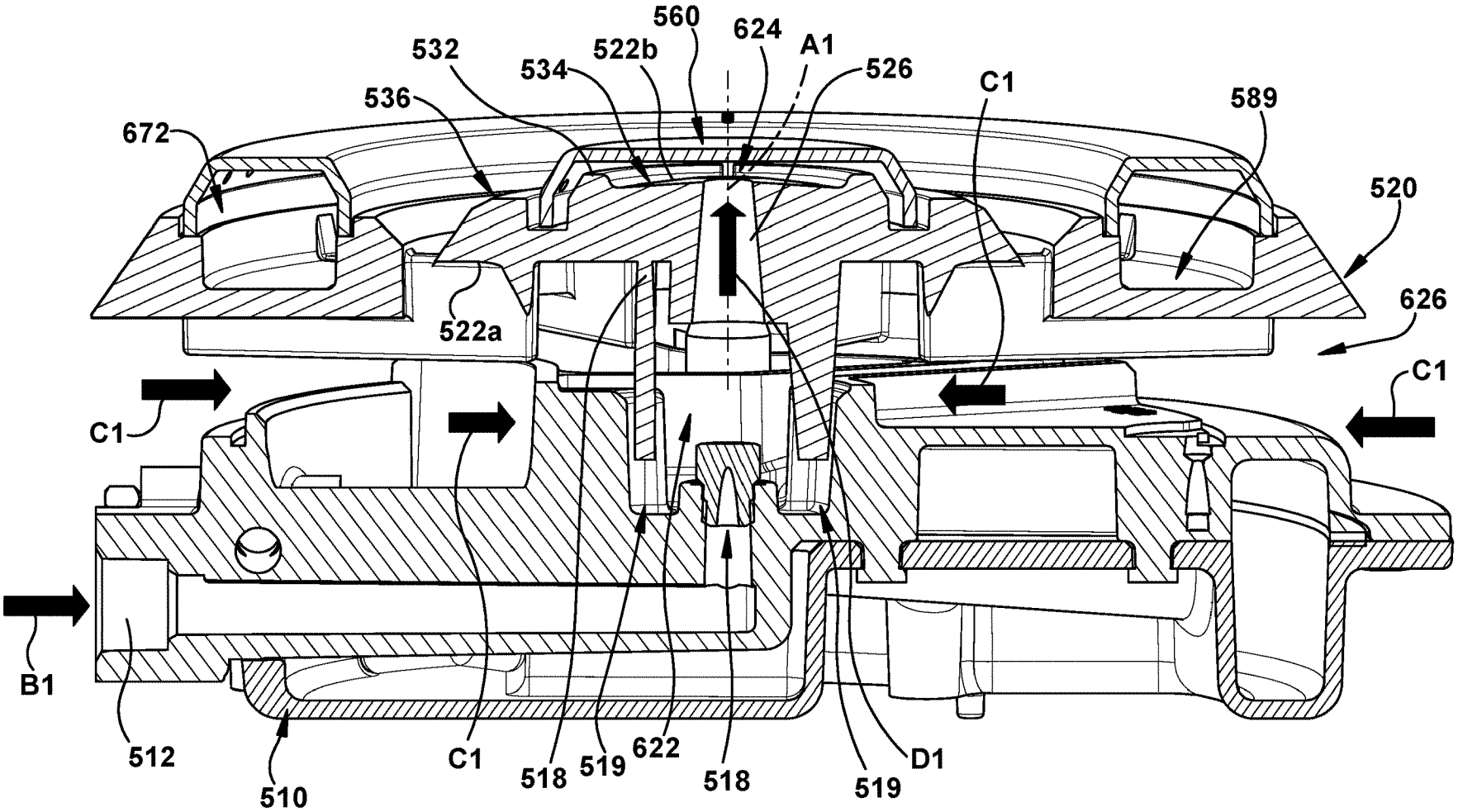
FIG. 18 is a side section view of the gas burner of FIG. 13 taken along line 17-17 of FIG. 13.

The burner 500 will now be described with respect to the operation of the gas burner 500. When the gas burner 500 is assembled, as described above, the orifice holder 510 and the inner body 522 of the base 520 define a central mixing chamber or mixing volume 622 (FIGS. 18 and 19) therebetween. Separately, the inner cap 560 and the base 520 define an upper central volume 624 (FIGS. 17 and 18) therebetween. Referring to FIG. 18, fuel (e.g. natural gas) fed from the first gas inlet port 512 enters the central mixing volume 622 via the first nozzle 513 in the orifice holder 510 along flow path B1. The gas passes through the first nozzle 513 and is ejected into the central mixing volume 622. The gas draws ambient air through a gap 626 between the orifice holder 510 and the base 520 along flow path C1 via a Venturi effect and causes the gas and the ambient air to mix in the central mixing volume 622.

Referring to FIG. 19, a portion of the air/fuel mixture is delivered into the upper central volume 624 along flow path D1 via the opening 526, and exits the upper central volume 624 along flow path E1 via gas burner ports 568 disposed at a periphery of the inner cap 560. The gas burner ports 568 are illustrated as a plurality of circular burner ports that are formed in the sloped upper portion 564 of the inner cap 560. It is contemplated that the gas burner ports 568 could have other shapes, for example, but not limited to, U-shaped, slanted slits, etc. Another portion of the air/fuel mixture also exits the upper central volume 624 along flow path F1 via a gap 628 disposed between the lower peripheral edge of the inner cap 560 and the base 520 to yield an annular curtain of flame emanating from the base of the inner cap 560 similarly as described above. The gap 628 and the associated curtain of flame are identical to the gap 244 and its resulting flame curtain described in detail above.

Referring to FIG. 15, a further portion of the air/fuel mixture flows along flow path G1 through the slot 552 in the raised annular band 532. As shown in FIG. 19, this portion of the air/fuel mixture is directed between the spark ignitor 518 and the spark target 548, where the spark ignitor 518 ignites it to generate a flame. The flame then ignites the air/fuel mixture exiting through the gap 628 to form the aforementioned "curtain" flame emanating from and substantially about the perimeter of the lower peripheral edge of the inner cap 560. This curtain flame is in addition to the main flames that exit from the gas burner ports 568. The curtain flame is a "carry-over" flame that connects or joins adjacent main flames. The curtain flame helps in re-igniting the main flames during accidental "blow-out," as explained below.

Referring to FIG. 19, as described in detail above, a portion of the air/fuel mixture is ejected in a vertical direction through the first outlet port 517*a* and the second outlet port 517*b* of the orifice holder 510. That portion flows along a flow path H1 from the first and second outlet ports 517*a*, 517*b* through the inlet ports 584*a*, 584*b* of the outer body 582, both into an outer annular cavity 672 formed between the outer body 582 and the outer cap 590 to fill that cavity 672 with the mixture. In the embodiment shown, the outer annular cavity 672 is annular in shape. The air/fuel mixture therein is ejected out gas ports 598 along flow path J1 and from gas ports 604 along flow path K1. The gas ports 604 are positioned such that the curtain flame emanating from the gap 628 ignites the portion of the air/fuel mixture ejected from the gas ports 604. This flame is then carried to the outer periphery of the outer cap 590 where it, in turn, ignites the gas emanating from the gas ports 598.

Because the gas burner 500 includes a first gas inlet port 512 and a second gas inlet port 514, it is contemplated that the intensity of the flames exiting the inner cap 560 and the outer cap 590 can be separately varied. In the embodiment shown, there is a single spark ignitor 518 that ignites only the air/fuel mixture from the inner cap 560. It is contemplated that a separate spark ignitor (not shown) may be used for the outer cap 590 to allow the air/fuel mixture exiting this cap to be ignited independent of the air/fuel mixture exiting the inner cap 560.

Illustrative embodiments have been described, hereinabove. It will be apparent to those skilled in the art that the above apparatuses and methods may incorporate changes and modifications without departing from the scope of this disclosure. The invention is therefore not limited to particular details of this disclosure except to the extent that the following claims are necessarily so limited.

What is claimed is:

1. A gas burner comprising:

a base including:

a first body having an opening extending axially through the first body, a raised annular band formed on an upper surface of the first body and surrounding an outlet of the opening, a flange about an outer periphery of the first body wherein the raised annular band and the flange define a first annular recess therebetween, a first notch formed in a lower surface of the first body extending through said flange and communicating with said first annular recess, said first notch adapted to accommodate a spark ignitor therein and defining a bridge having a spark target disposed on a bottom surface of the bridge, and a slot formed in the raised annular band; and a first cap including:

a peripheral side wall having a distal end dimensioned to be received and accommodated within said first annular recess, wherein a gap between said distal end and a bottom wall of the first annular recess when said first cap is received therein provides fluid communication between said slot and said first notch, and a gas burner port formed in the peripheral side wall of the first cap.

2. The gas burner according to claim 1, further comprising:

a second notch formed in an upper portion of said flange; and a stability chamber extending from the lower surface of said first body aligned with the second notch.

3. The gas burner according to claim 2, wherein a plurality of stand-offs protrude from the bottom wall of the first annular recess and the distal end of the peripheral side wall rests on the stand-offs to yield said gap when received in the first annular recess, and two of the plurality of stand-offs are disposed adjacent to opposite sides of the second notch.

4. The gas burner according to claim 1, further comprising an outer burner portion comprising:

a second, outer body surrounding the first body and having a second annular recess therein, and a second, outer cap adapted to be supported on said second, outer body and therewith to define an outer annular cavity, a row of gas burner ports extending radially in an upper surface of the second, outer cap and fluidly communicating with the outer annular cavity, and a plurality of gas burner ports disposed and spaced circumferentially in an outer wall of the second, outer cap.

5. The gas burner according to claim 4, said second, outer body being a ring-shaped body having an inner wall, an outer wall, and an inlet port, and said second, outer cap having an outer wall engaging the outer wall of the ring-shaped body when resting thereon, and a downward facing inner wall engaging the inner wall of the ring-shaped body when resting thereon.

6. An appliance having a cooktop panel and the gas burner of claim 4 mounted on the cooktop panel, the first and second bodies of the gas burner having respective first and second lower surfaces spaced above the cooktop panel to define a circumferential air inlet of the gas burner fluidly connected to the opening extending axially through the base.

7. The appliance according to claim 6, wherein a plurality of stand-offs protrude from the bottom wall of the first annular recess and the distal end of the peripheral side wall of the first cap rests on the stand-offs to space the distal end of the peripheral side wall of the first cap above a bottom of the first annular recess to thereby yield said gap.

8. The appliance according to claim 6, further comprising:

a second notch formed in an upper portion of said flange; and a stability chamber extending from the lower surface of said first body and aligned with the second notch.

9. The gas burner according to claim 1, comprising a plurality of gas burner ports formed and spaced circumferentially in the peripheral side wall of the first cap, wherein in use a curtain flame emanating from said gap and formed about an outer periphery of the first cap is continuous between at least two of said gas burner ports in the peripheral side wall of said first cap.

10. The gas burner according to claim 1, wherein in use a curtain flame emanating from said gap and formed about an outer periphery of the first cap is continuous around the entire periphery of the first cap.

11. An appliance having a cooktop panel and the gas burner of claim 1 mounted on the cooktop panel.

12. The appliance according to claim 11, wherein a lower surface of the first body is spaced above the cooktop panel to provide fluid communication between a surrounding environment and the opening extending axially through the first body.

13. A gas burner comprising:

a base including:

a first body having an opening extending axially through the first body, a raised annular band formed on an upper surface of the first body and surrounding an outlet of the opening, a flange about an outer periphery of the first body wherein the raised annular band and the flange define a first annular recess therebetween, a plurality of stand-offs protruding from a bottom wall of the first annular recess, a first notch formed in a lower surface of the first body extending through said flange and communicating with said first annular recess, said first notch adapted to accommodate a spark ignitor therein, and a slot formed in the raised annular band; and a first cap including:

a peripheral side wall having a distal end dimensioned to be received and accommodated within said first annular recess, wherein a gap between said distal end and the bottom wall of the first annular recess when said first cap is received therein provides fluid communication between said slot and said first notch and the distal end of the peripheral side wall rests on the stand-offs to yield said gap when received in the first annular recess, and a gas burner port formed in the peripheral side wall of the first cap.

14. The gas burner according to claim 13, wherein two of the plurality of stand-offs are disposed adjacent to opposite sides of the first notch.

15. A method of operating a gas burner comprising steps of:

flowing a combustible gas through a mixing chamber formed in a body of the gas burner wherein the combustible gas draws surrounding air into the mixing chamber through a circumferential opening defined between a bottom of the body and a top of a cooktop panel to which the gas burner is mounted;

combining the combustible gas and air in the mixing chamber to form a mixture;

flowing the mixture to an upper volume of the gas burner;

a first portion of the mixture being exhausted from the upper volume via a first flow path passing through at least one gas burner port formed in a cap of the gas burner, a second portion of the mixture being exhausted from the upper volume via a second flow path passing through a slot formed in an upper surface of the body and then through a notch formed in a lower surface of the body of the gas burner, the notch defining a bridge having a spark target disposed on a bottom surface thereof, and a third portion of the mixture being exhausted from the upper volume via a gap between a distal end of a side wall of said cap and the upper surface of the body, said cap resting on or above said upper surface; and igniting the second portion of the mixture on exiting the gas burner through said notch, thereby subsequently igniting the first portion of the mixture exiting the gas burner port and the third portion of the mixture exiting the gap.

16. The method of claim 15 wherein the third portion of the mixture exiting the gas burner via the gap forms a curtain flame extending circumferentially between adjacent circumferentially spaced ones of said at least one gas burner port in said cap for reigniting the first portion of the mixture exiting the adjacent gas burner ports in the event that flames from combusting the first portion of the mixture exiting therefrom is extinguished.

17. The method of claim 16, said curtain flame being continuous about the entire periphery of the cap.

* * * * *